US007137577B2

(12) United States Patent
Goenka et al.

(10) Patent No.: US 7,137,577 B2
(45) Date of Patent: Nov. 21, 2006

(54) LOW PRESSURE FUEL INJECTOR NOZZLE

(75) Inventors: Lakhi N. Goenka, Ann Arbor, MI (US); Jeffrey Paul Mara, Livonia, MI (US); David Lee Porter, Westland, MI (US); James Raymond Winkelman, Bloomfield, MI (US); David Ling-Shun Hung, Novi, MI (US); John Stefanski, Pinckney, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 54 days.

(21) Appl. No.: 10/982,647

(22) Filed: Nov. 5, 2004

(65) Prior Publication Data

US 2006/0097078 A1 May 11, 2006

(51) Int. Cl.
*F02M 61/00* (2006.01)
*F02M 59/00* (2006.01)

(52) U.S. Cl. ..... 239/533.12; 239/598; 239/596; 239/601; 239/533.2

(58) Field of Classification Search ..... 239/533.2, 239/533.12, 598, 601, 596, 494, 497
See application file for complete search history.

(56) References Cited

U.S. PATENT DOCUMENTS 3,326,191 A 6/1967 Berlyn
4,018,387 A 4/1977 Erb et al.
4,106,702 A 8/1978 Gardner et al.
4,139,158 A 2/1979 Uehida
4,254,915 A 3/1981 Muller
4,275,845 A 6/1981 Muller
4,346,848 A 8/1982 Malcolm
4,540,126 A 9/1985 Yoneda et al.
4,647,013 A * 3/1987 Giachino et al. ..... 251/331
4,650,122 A 3/1987 Klenzle et al.
4,666,088 A 5/1987 Krauss et al.
4,801,095 A 1/1989 Banzhaf et al.
4,826,131 A * 5/1989 Mikkor ..... 251/129.17
4,907,748 A 3/1990 Gardner et al.
5,163,621 A 11/1992 Kato et al.
5,201,806 A 4/1993 Wood
5,244,154 A 9/1993 Buchholz et al.
5,344,081 A 9/1994 Wakeman
5,383,597 A 1/1995 Sooriakumar et al.
5,402,943 A 4/1995 King et al.
5,449,114 A 9/1995 Wells et al.
5,497,947 A 3/1996 Potz et al.
5,533,482 A 7/1996 Naitoh
5,553,790 A 9/1996 Findler et al.
5,570,841 A 11/1996 Pace et al.
5,636,796 A 6/1997 Oguma
5,662,277 A 9/1997 Taubitz et al.
5,685,485 A 11/1997 Mock et al.
5,685,491 A 11/1997 Marks et al.
5,716,001 A 2/1998 Wakeman et al.

(Continued)

FOREIGN PATENT DOCUMENTS

EP 0 551 633 A1 7/1993

(Continued)

*Primary Examiner*—Dinh Q. Nguyen
(74) *Attorney, Agent, or Firm*—Brinks Hofer Gilson & Lione

(57) ABSTRACT

A nozzle for a low pressure fuel injector that improves the control and size of the spray angle, as well as enhances the atomization of the fuel delivered to a cylinder of an engine.

13 Claims, 3 Drawing Sheets

U.S. PATENT DOCUMENTS

| | | | |
|---|---|---|---|
| 5,716,009 | A | 2/1998 | Ogihara et al. |
| 5,762,272 | A | 6/1998 | Tani et al. |
| 5,911,366 | A | 6/1999 | Maier et al. |
| 5,915,352 | A | 6/1999 | Okamoto et al. |
| 5,924,634 | A | 7/1999 | Arndt et al. |
| 5,934,571 | A | 8/1999 | Schmidt et al. |
| 6,029,913 | A | 2/2000 | Stroia et al. |
| 6,045,063 | A | 4/2000 | Koike et al. |
| 6,050,507 | A | 4/2000 | Holzgrefe et al. |
| 6,092,743 | A | 7/2000 | Shibata et al. |
| 6,102,299 | A | 8/2000 | Pace et al. |
| 6,168,094 | B1 | 1/2001 | Schatz et al. |
| 6,168,095 | B1 | 1/2001 | Seitter et al. |
| 6,176,441 | B1 | 1/2001 | Munezane et al. |
| 6,257,496 | B1 | 7/2001 | Wyant |
| 6,273,349 | B1 | 8/2001 | Fischbach et al. |
| 6,296,199 | B1 | 10/2001 | Noller et al. |
| 6,308,901 | B1 | 10/2001 | Nitkiewicz et al. |
| 6,330,981 | B1 | 12/2001 | Nally, Jr. et al. |
| 6,394,367 | B1 | 5/2002 | Munezane et al. |
| 6,405,945 | B1 | 6/2002 | Dobrin |
| 6,439,482 | B1 | 8/2002 | Hosoyama et al. |
| 6,439,484 | B1 | 8/2002 | Harata et al. |
| 6,494,388 | B1 | 12/2002 | Mueller et al. |
| 6,499,674 | B1 | 12/2002 | Ren et al. |
| 6,502,769 | B1 | 1/2003 | Imoehl |
| 6,513,724 | B1 | 2/2003 | Joseph et al. |
| 6,520,145 | B1 | 2/2003 | Hunkert |
| 6,533,197 | B1 | 3/2003 | Takeuchi et al. |
| 6,547,163 | B1 | 4/2003 | Mansour et al. |
| 6,578,778 | B1 | 6/2003 | Koizumi et al. |
| 6,581,574 | B1 | 6/2003 | Moran et al. |
| 6,616,072 | B1 | 9/2003 | Harata et al. |
| 6,626,381 | B1 | 9/2003 | Parrish |
| 6,644,565 | B1 | 11/2003 | Hockenberger |
| 6,666,388 | B1 | 12/2003 | Ricco |
| 6,669,103 | B1 | 12/2003 | Tsai |
| 6,669,116 | B1 | 12/2003 | Iwase |
| 6,685,112 | B1 | 2/2004 | Hornby et al. |
| 6,695,229 | B1 | 2/2004 | Heinbuch et al. |
| 6,705,274 | B1 | 3/2004 | Kubo |
| 6,708,904 | B1 | 3/2004 | Itatsu |
| 6,708,905 | B1 | 3/2004 | Borissov et al. |
| 6,708,907 | B1 | 3/2004 | Fochtman et al. |
| 6,712,037 | B1 | 3/2004 | Xu |
| 6,719,223 | B1 | 4/2004 | Yukinawa et al. |
| 6,722,340 | B1 | 4/2004 | Sukegawa et al. |
| 6,739,525 | B1 | 5/2004 | Dantes et al. |
| 6,742,727 | B1 | 6/2004 | Peterson, Jr. |
| 6,758,420 | B1 | 7/2004 | Arioka et al. |
| 6,764,033 | B1 | 7/2004 | Dantes et al. |
| 6,766,969 | B1 | 7/2004 | Haltiner, Jr. et al. |
| 6,783,085 | B1 | 8/2004 | Xu |
| 6,817,545 | B1 | 11/2004 | Xu |
| 6,848,635 | B1 * | 2/2005 | Xu ..... 239/533.12 |
| 6,848,636 | B1 | 2/2005 | Munezane et al. |
| 6,921,022 | B1 | 7/2005 | Nally et al. |
| 6,929,196 | B1 | 8/2005 | Togashi et al. |
| 6,966,499 | B1 | 11/2005 | Nally et al. |
| 2001/0017325 | A1 | 8/2001 | Harata et al. |
| 2002/0008166 | A1 | 1/2002 | Fukaya et al. |
| 2002/0092929 | A1 | 7/2002 | Arimoto |
| 2002/0144671 | A1 | 10/2002 | Shiraishi et al. |
| 2002/0170987 | A1 | 11/2002 | Aoki et al. |
| 2003/0127540 | A1 | 7/2003 | Xu |
| 2003/0127547 | A1 | 7/2003 | Nowak |
| 2003/0141385 | A1 | 7/2003 | Xu |
| 2003/0141387 | A1 | 7/2003 | Xu |
| 2003/0173430 | A1 | 9/2003 | Spencer |
| 2003/0234005 | A1 | 12/2003 | Sumisha et al. |
| 2004/0050976 | A1 | 3/2004 | Kitamura |
| 2004/0060538 | A1 | 4/2004 | Togashi et al. |
| 2004/0104285 | A1 | 6/2004 | Okamoto et al. |
| 2004/0129806 | A1 | 7/2004 | Dantes et al. |

FOREIGN PATENT DOCUMENTS

| | | |
|---|---|---|
| EP | 0 611 886 B1 | 12/1998 |
| GB | 2 232 203 A | 12/1990 |
| JP | 2-19654 | 1/1990 |
| JP | 5-280442 | 1/1993 |
| JP | 6-221163 | 8/1994 |
| JP | 2001-046919 | 2/2001 |
| WO | WO 93/04277 | 3/1993 |
| WO | WO 93/20349 | 10/1993 |
| WO | WO 95/04881 | 2/1995 |

* cited by examiner

LOW PRESSURE FUEL INJECTOR NOZZLE

FIELD OF THE INVENTION

The present invention relates generally to fuel injectors for automotive engines, and more particularly relates to fuel injector nozzles capable of atomizing fuel at relatively low pressures.

BACKGROUND OF THE INVENTION

Stringent emission standards for internal combustion engines suggest the use of advanced fuel metering techniques that provide extremely small fuel droplets. The fine atomization of the fuel not only improves emission quality of the exhaust, but also improves the cold weather start capabilities, fuel consumption and performance. Typically, optimization of the droplet sizes dependent upon the pressure of the fuel, and requires high pressure delivery at roughly 7 to 10 MPa. However, a higher fuel delivery pressure causes greater dissipation of the fuel within the cylinder, and propagates the fuel further outward away from the injector nozzle. This propagation makes it more likely that the fuel spray will condense on the walls of the cylinder and the top surface of the piston, which decreases the efficiency of the combustion and increases emissions.

To address these problems, a fuel injection system has been proposed which utilizes low pressure fuel, define herein as generally less than 4 MPa, while at the same time providing sufficient atomization of the fuel. One exemplary system is found in U.S. Pat. No. 6,712,037, commonly owned by the Assignee of the present invention, the disclosure of which is hereby incorporated by reference in its entirety. Generally, such low pressure fuel injectors employ sharp edges at the nozzle orifice for atomization and acceleration of the fuel. However, the relatively low pressure of the fuel and the sharp edges result in the spray being difficult to direct and reduces the range of the spray. More particularly, the spray angle or cone angle produced by the nozzle is somewhat more narrow. At the same time, additional improvement to the atomization of the low pressure fuel would only serve to increase the efficiency and operation of the engine and fuel injector.

Accordingly, there exists a need to provide a fuel injector having a nozzle design capable of sufficiently injecting low pressure fuel while increasing the control and size of the spray angle, as well as enhancing the atomization of the fuel.

BRIEF SUMMARY OF THE INVENTION

One embodiment of the present invention provides a nozzle for a low pressure fuel injector which enhances the atomization of the fuel that is delivered to a cylinder of an engine. The nozzle generally comprises a nozzle body and a metering plate. The nozzle body defines a valve outlet in a longitudinal axis. The metering plate is connected to the nozzle body and is in fluid communication with the valve outlet. The metering plate defines a nozzle cavity receiving fuel from the valve outlet through an entrance orifice. The nozzle cavity is defined by a bottom wall and a side wall. The metering plate defines a plurality of exit cavities receiving fuel from the nozzle cavity. Each exit cavity is radially spaced from the longitudinal axis and oriented along a radial axis. Each exit cavity meets the nozzle cavity at an exit orifice. Each exit orifice includes an annular wall extending around the exit orifice and projecting up from the bottom wall into the nozzle cavity.

According to more detailed aspects, another annular wall is provided which extends around the entrance orifice and projects into the nozzle cavity. Either annular wall may follow a zig-zag line around the orifice. Either annular wall may include vertical serrations. The bottom wall in the area adjacent each exit orifice preferably includes a plurality of linear grooves. The grooves preferably extend in a direction non-aligned with the radial axis of the adjacent orifice. The annular walls may be intermittent or continuous.

Another embodiment of the present invention provides a nozzle for a low pressure fuel injector which delivers fuel to a cylinder of an engine. The nozzle generally comprises a nozzle body and a metering plate. The nozzle body defines a valve outlet in a longitudinal axis, while the metering plate is connected to the nozzle body and in fluid communication with the valve outlet. The metering plate defines a nozzle cavity receiving fuel from the valve outlet through an entrance orifice, the nozzle cavity defined by a bottom wall and a side wall. The metering plate defines a plurality of exit cavities receiving fuel from the nozzle cavity, each exit cavity being radially spaced from a longitudinal axis and oriented along a radial axis. Each exit cavity meets the nozzle cavity at an exit orifice. The bottom wall of the nozzle cavity in the area circumscribing each exit orifice has a plurality of linear grooves.

According to more detailed aspects, the grooves extend in a direction non-aligned with the radial axis of the adjacent orifice. Preferably, the grooves extend in a direction perpendicular to the radial axis of the adjacent orifice. The grooved area of the bottom wall extends completely up to the exit orifice. The grooved area may be circular, square or rectangular in shape.

BRIEF DESCRIPTION OF THE DRAWINGS

The accompanying drawings incorporated in and forming a part of the specification illustrate several aspects of the present invention, and together with the description serve to explain the principles of the invention. In the drawings.

DETAILED DESCRIPTION OF THE INVENTION

Figure 1:
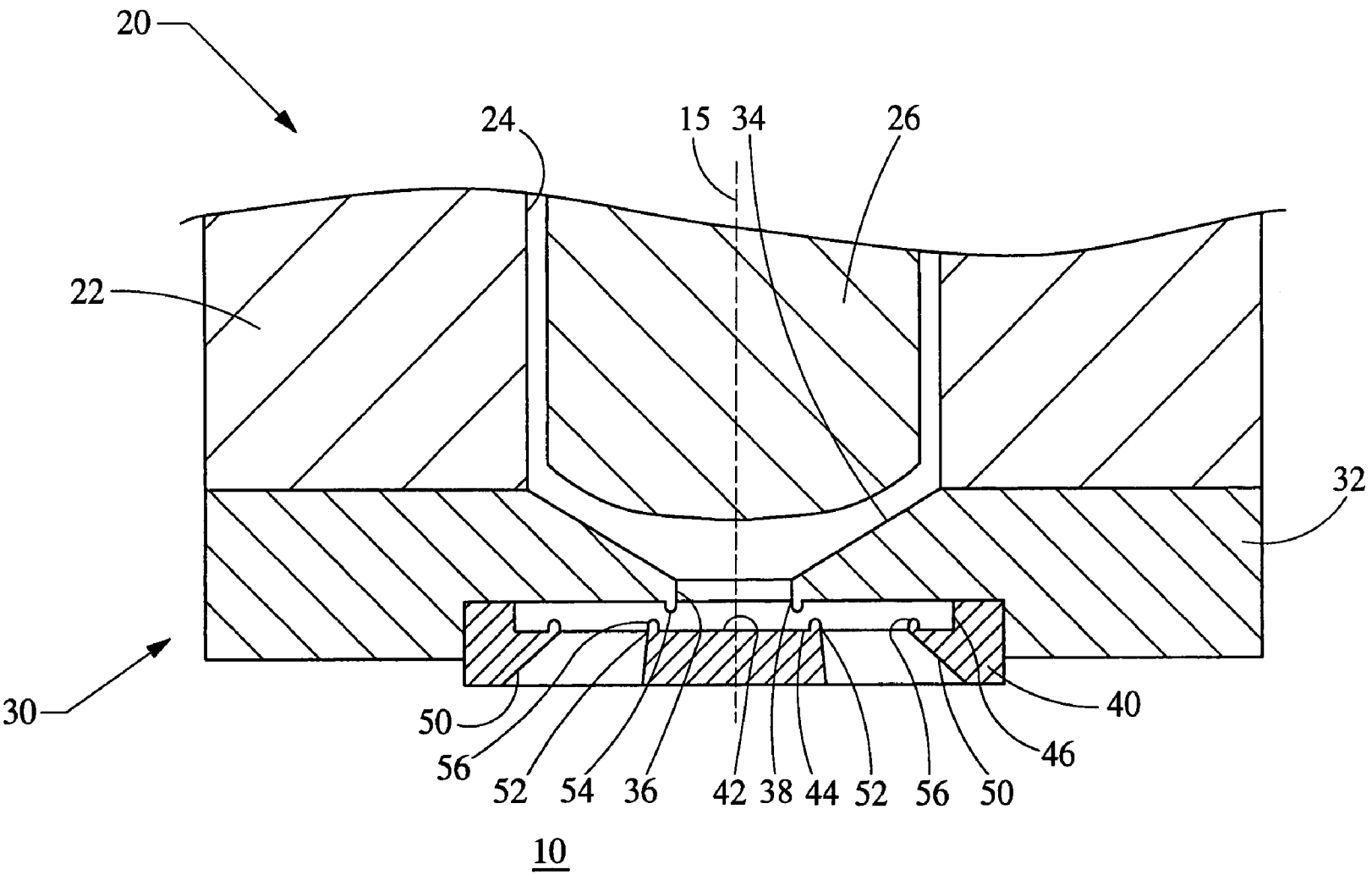
FIG. 1 depicts a cross-sectional view, partially cut-away of a nozzle for a low pressure fuel injector constructed in accordance with the teachings of the present invention.

Turning now to the figures, FIG. 1 depicts a cross-sectional of a nozzle 20 constructed in accordance with the teachings of the present invention. The nozzle 20 is formed at a lower end of a low pressure fuel injector which is used to deliver fuel to a cylinder 10 of an engine, such as an internal combustion engine of an automobile. An injector body 22 defines an internal passageway 24 having a needle 26 positioned therein. The injector body 22 defines a longitudinal axis 15, and the internal passageway 24 extends generally parallel to the longitudinal axis 15. A lower end of the injector body 22 defines a nozzle body 32. It will be recognized by those skilled in the art that the injector body 22 and nozzle body 32 may be integrally formed, or alternatively the nozzle body 32 may be separately formed and attached to the distal end of the injector body 22 by welding or other well known techniques.

In either case, the nozzle body 32 defines a valve seat 34 leading to a valve outlet 36. The needle 26 is translated longitudinally in and out of engagement with the valve seat 34 preferably by an electromagnetic actuator or the like. In this manner, fuel flowing through the internal passageway 24 and around the needle 26 is either permitted or prevented from flowing to the valve outlet 36 by the engagement or disengagement of the needle 26 and valve seat 34.

The nozzle 20 further includes a metering plate 40 which is attached to the nozzle body 32. It will be recognized by those skilled in the art that the metering plate 40 may be integrally formed with the nozzle body 32, or alternatively may be separately formed and attached to the nozzle body 32 by welding or other well known techniques. In either case, the metering plate 40 defines a nozzle cavity 42 receiving fuel from the valve outlet 36. The nozzle cavity 42 is generally defined by a bottom wall 44 and a side wall 46 which are formed into the metering plate 40. The metering plate 40 further defines a plurality of exit cavities 50 receiving fuel from the nozzle cavity 42. Each exit cavity 50 is radially spaced from the longitudinal axis 15 and meets the nozzle cavity 42 at an exit orifice 52.

As can also be seen in FIG. 1, the metering plate 40 includes an annular wall 56 extending around each exit orifice 52. Similarly, the nozzle body 32 provides an annular wall 54 extending around the entrance orifice 38. The nozzle cavity 42 meets the valve outlet 36 at an entrance orifice 38. Accordingly, it will be seen that fuel flowing through the valve outlet 36 must flow downwardly and radially outwardly around the annular wall 54, and then upwardly and radially outwardly around the other annular wall 56 in order to reach the exit cavity 50. In this manner, atomization of the fuel is enhanced by adding turbulence to the fuel flowing through the metering plate 40. It will be recognized that the annular walls 54, 56 can be either continuous or intermittent.

Figure 2:
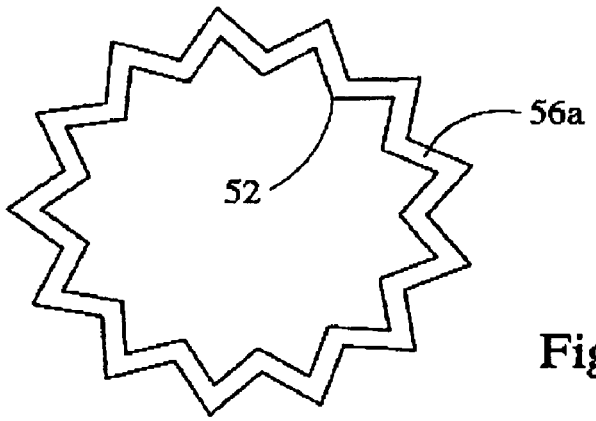
FIG. 2 is a plan view of an annular wall forming a portion of the nozzle depicted in FIG. 1.

Turning to FIG. 2, another embodiment of the annular wall 56 has been depicted and denoted as 56*a*. It can be seen from the figure that the annular wall 56*a* follows a zig-zag or star-shape around the perimeter of the exit orifice 52. It will be recognized by those skilled in the art that the other annular wall 54 may also take this shape. It can also be seen that the exit orifice 52 also takes the zig-zag shape. By way of this structure, additional turbulence is added to the fuel flow through the metering plate 40 to further enhance atomization.

Figure 3:
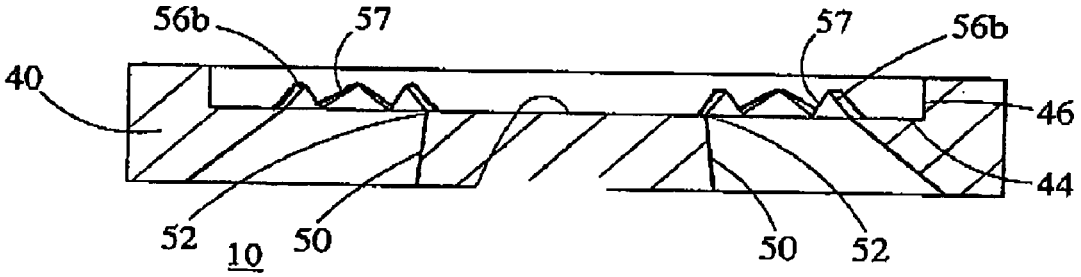
FIG. 3 is a cross-sectional view of an alternate embodiment of a metering plate forming a portion of the nozzle depicted in FIG. 1.

Turning now to FIG. 3, yet another embodiment of the annular wall 56 is shown and is denoted as 56*b*. In this embodiment, the annular wall 56*b* includes vertical serrations 57. These serrations 57 and the annular walls 56*b* further increase the turbulence of the fuel flowing through the metering plate 40, thereby improving the atomization of the fuel.

Figure 4:
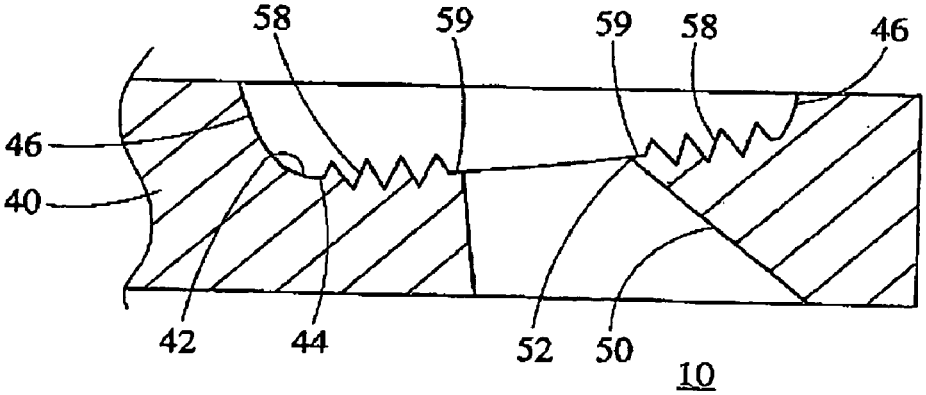
FIG. 4 is a cross-sectional view, partially cut-away, of an alternate embodiment of the metering plate forming a portion of the nozzle depicted in FIG. 1.

Turning now to FIG. 4, still yet another embodiment of the metering plate 40 is shown which increases the turbulence and enhances atomization of the fuel. As shown, the bottom wall 44 of the nozzle cavity 42 includes serrations 58 formed in an area circumscribing each exit orifice 52 in exit cavity 50. More particularly, the serrations 58 rise above the level of the bottom wall 44 of the nozzle cavity 42. In essence, the serrations 58 form a plurality of annular walls extending around each exit orifice 52. It can also be seen that the serrations 58 stop short of the exit orifice 52 and leave a generally planar area 59 extending around the exit orifice 52.

Figure 5:
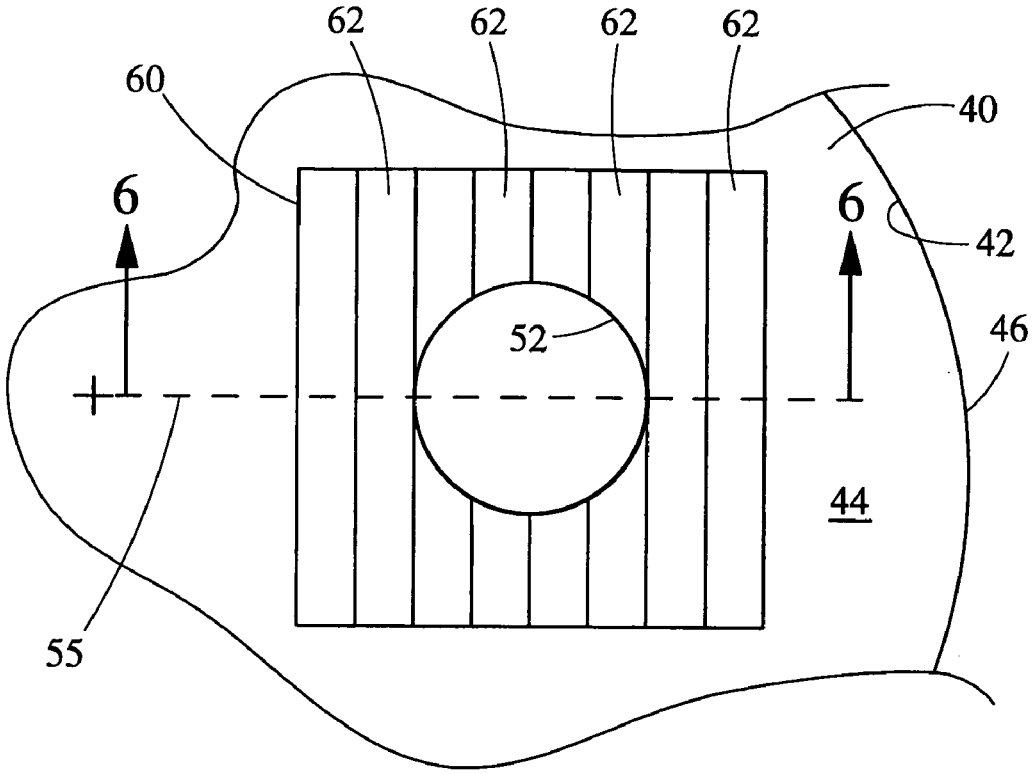
FIG. 5 is a plan view, partially cut-away, of an alternate embodiment of a metering plate forming a portion of the nozzle depicted in FIG. 1.
Figure 6:
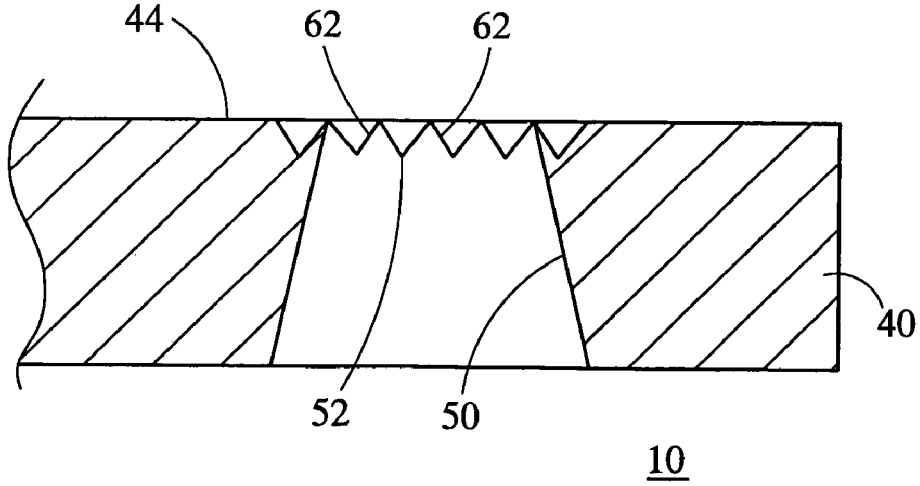
FIG. 6 is cross-sectional view, partially cut-away, of the metering plate depicted in FIG. 5.

A related embodiment is shown in FIGS. 5 and 6. In this embodiment, an area 60 of the bottom wall 44 adjacent each exit orifice 52 includes a plurality of linear grooves 62. As shown in FIG. 6, the grooves 62 extend downwardly into the nozzle body 40. The grooves extend in a direction not aligned with the radial axis 55 of the adjacent exit orifice 52, and preferably is generally perpendicular to the radial axis 55. As best seen in FIG. 6, the exit orifice 52 will inherently take a serrated or zig-zag shape corresponding to the grooves 62 formed into the bottom wall 44. The grooved area may be square or rectangular in shape, or may also generally circular in shape to correspond with the shape of the exit orifice 52. In this manner, the fuel flow will encounter the series of grooves 62 as it flows radially outward to the exit orifice 52 and exit cavity 50, thereby increasing the turbulence thereof and promoting atomization of the fuel flowing to the engine cylinder 10.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. A nozzle for a low pressure fuel injector, the fuel injector delivering fuel to a cylinder of an engine, the nozzle comprising:

a nozzle body defining a valve outlet and a longitudinal axis;

a metering plate connected to the nozzle body and in fluid communication with the valve outlet;

the metering plate defining a nozzle cavity receiving fuel from the valve outlet through an entrance orifice, the nozzle cavity defined by a bottom wall and a side wall;

the metering plate defining a plurality of exit cavities receiving fuel from the nozzle cavity, each exit cavity radially spaced from the longitudinal axis and oriented along a radial axis, each exit cavity meeting the nozzle cavity at an exit orifice; and each exit orifice including an annular wall extending around the exit orifice and projecting up from the bottom wall into the nozzle cavity.

2. The nozzle of claim 1, further comprising another annular wall extending around the entrance orifice and projecting into the nozzle cavity.

3. The nozzle of claim 1, wherein the annular wall follows a zig-zag line around the exit orifice.

4. The nozzle of claim 1, wherein the annular wall includes vertical serrations.

5. The nozzle of claim 1, wherein the bottom wall in the area adjacent each exit orifice includes a plurality of linear grooves.

6. The nozzle of claim 5, wherein the grooves extend in a direction non-aligned with the radial axis of the adjacent orifice.

7. The nozzle of claim 5, wherein the grooved area of the bottom wall extends completely up to the exit orifice.

8. The nozzle of claim 1, wherein the annular wall is intermittent.

9. The nozzle of claim 1, wherein the annular wall is continuous.

10. The nozzle of claim 5, wherein the grooves extend in a direction perpendicular to the radial axis of the adjacent orifice.

11. The nozzle of claim 5, wherein the grooved area is square or rectangular in shape.

12. The nozzle of claim 1, wherein the bottom wall in the area adjacent each exit orifice includes a plurality of annular grooves.

13. The nozzle of claim 12, wherein the grooved area leaves a flat area adjacent the exit orifice.

* * * * *